US011519664B2

(12) United States Patent
Wantland et al.

(10) Patent No.: US 11,519,664 B2
(45) Date of Patent: Dec. 6, 2022

(54) RETRACTABLE SOFT-CLOSE SHELF SYSTEM

(71) Applicant: Haier US Appliance Solutions, Inc., Wilmington, DE (US)

(72) Inventors: Louis A. Wantland, Louisville, KY (US); Alisa Marie Stoops, Louisville, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 45 days.

(21) Appl. No.: 16/930,498

(22) Filed: Jul. 16, 2020

(65) Prior Publication Data

US 2022/0018594 A1 Jan. 20, 2022

(51) Int. Cl.

| | |
|---|---|
| ***F25D 25/02*** | (2006.01) |
| ***A47B 96/02*** | (2006.01) |
| *A47B 88/467* | (2017.01) |

(52) U.S. Cl.

CPC ..... *F25D 25/024* (2013.01); *A47B 96/025* (2013.01); *A47B 88/467* (2017.01); *F25D 2325/021* (2013.01)

(58) Field of Classification Search

CPC ..... F25D 25/024; F25D 2325/021; A47B 96/025

See application file for complete search history.

(56) References Cited

U.S. PATENT DOCUMENTS

| | | | | |
|---|---|---|---|---|
| 2,033,860 | A | 3/1936 | Otte | |
| 3,570,680 | A | 3/1971 | Klassen | |
| 5,340,209 | A * | 8/1994 | Kolbe | F25D 25/024 312/334.46 |
| 7,384,108 | B2 * | 6/2008 | Lam | A47B 88/467 312/333 |
| 7,712,852 | B2 | 5/2010 | Choi et al. | |
| 8,091,971 | B2 | 1/2012 | Ward et al. | |
| 8,136,898 | B2 * | 3/2012 | Ruter | E05B 65/46 312/333 |
| 8,777,341 | B2 | 7/2014 | Amaral | |
| 8,814,285 | B2 | 8/2014 | Park et al. | |

(Continued)

FOREIGN PATENT DOCUMENTS

| | | | |
|---|---|---|---|
| CN | 108050759 | A | 5/2018 |
| JP | 5320228 | B2 | 10/2013 |
| KR | 20090066769 | A | 6/2009 |

*Primary Examiner* — Kimberley S Wright

(74) *Attorney, Agent, or Firm* — Dority & Manning, P.A.

(57) ABSTRACT

Retractable soft-close shelf system and assemblies for use with appliance are provided. Shelf assembly includes a fixed shelf with a guide defining a support surface and a movable shelf slidably mounted to the fixed shelf. Movable shelf can be moved between an extended and a retracted position Support surface can include a front portion and a rear portion. Front portion is positioned at a first guide angle and rear portion is positioned at a second guide angle. Movable shelf includes a front boss and a rear boss on opposite sides of the movable shelf. Front and rear bosses are received within the guide and are slidably supported by the support surface. Shelf assembly includes a striker extending from the bottom of the movable shelf and a soft close mechanism. Soft close mechanism is configured to engage the striker when rear boss contacts the rear portion of the support surface.

15 Claims, 9 Drawing Sheets

(56) References Cited

U.S. PATENT DOCUMENTS

| | | | | |
|---|---|---|---|---|
| 8,840,205 | B2 | 9/2014 | Chellappan et al. | |
| 9,103,582 | B2 | 8/2015 | Nash et al. | |
| 9,872,563 | B2 | 1/2018 | Davis | |
| 10,820,725 | B1 * | 11/2020 | Fagundes | F25D 25/025 |
| 10,823,492 | B2 * | 11/2020 | Oh | F25D 23/067 |
| 11,047,617 | B1 * | 6/2021 | Bassler | F25D 25/024 |
| 2003/0136750 | A1 * | 7/2003 | Fujii | A47F 5/0093 211/90.02 |
| 2005/0258725 | A1 * | 11/2005 | Jang | F25D 25/024 312/408 |
| 2007/0228909 | A1 | 10/2007 | Hwang | |
| 2009/0309470 | A1 * | 12/2009 | Ruter | A47B 88/467 312/334.1 |
| 2011/0095670 | A1 | 4/2011 | Cho et al. | |
| 2014/0239792 | A1 | 8/2014 | Chellappan et al. | |
| 2016/0216027 | A1 * | 7/2016 | Go | F25D 25/025 |
| 2018/0128538 | A1 * | 5/2018 | Jang | A47B 96/025 |
| 2020/0072536 | A1 * | 3/2020 | Oh | A47B 96/025 |
| 2020/0200468 | A1 * | 6/2020 | Eom | A47B 96/028 |
| 2020/0224959 | A1 * | 7/2020 | Wantland | A47B 88/467 |
| 2021/0025649 | A1 * | 1/2021 | Oh | F25D 23/028 |

* cited by examiner

RETRACTABLE SOFT-CLOSE SHELF SYSTEM

FIELD

The present disclosure relates generally to appliances and more particularly to shelf systems for use in appliances, such as refrigerators.

BACKGROUND

Consumer appliances, such as refrigerator appliances, generally include a cabinet that defines one or more internal chambers. In the case of refrigerator appliances, a chilled chamber may be defined for receipt of food articles for storage. Consumer appliances can also include various storage components mounted within the one or more internal chambers and designed to facilitate storage of items therein. For example, refrigerator appliances can include various storage components within the chilled chamber, which are designed to facilitate storage of food items. Such storage components can include racks, bins, shelves, or drawers that receive food items and assist with organizing and arranging food items within the chilled chamber.

Some existing refrigerator appliances include one or more shelves for holding or supporting food items within the chilled chamber. Certain refrigerator appliances can include adjustable shelves that permit a user to change the positioning of the shelves into various configurations. For example, adjustable shelves can permit a user to change the length, height or another dimension of the shelves.

For example, existing refrigerator appliances can also contain adjustable shelves that include a fixed plate and a movable plate that can slide relative to the fixed plate. These adjustable shelves can include supports which support the fixed plate and movable plate. The supports can also contain one or more channels or ramps which support a portion of the movable plate and facilitate the sliding of movable plate relative to the fixed plate. The channels or ramps can be sloped or angled such that the movement of the movable plate is aided by gravity.

These existing approaches present certain challenges. For instance, the channels or ramps must have dimensions that are significantly larger than the thickness of the portions of the movable plate supported therein, thus reducing storage capacity of the chilled chamber. Further, the movable shelves mounted to such gravity assisted channels or ramps may require larger channels or ramps to increase the space between the movable plate and guides to avoid binding, sticking or dragging of the movable plate, which can negatively impact the operation of the movable plate or cause the plate to become stuck, partially or fully inoperable. The requisite increased tolerance of the gravity assisted channels or ramps can cause a user to perceive the movement of the movable plate to be loose, noisy or irregular. These characteristics can cause a user to perceive the adjustable or movable shelf or the appliance, in whole or in part, to be of lesser quality or cause a user to perceive the appliance as including insufficient craftsmanship.

Accordingly, an appliance with features that address one or more of the challenges noted above would be useful and welcomed.

BRIEF DESCRIPTION

Aspects and advantages of embodiments of the present disclosure will be set forth in part in the following description, or may be learned from the description, or may be learned through practice of the embodiments.

One example aspect of the present disclosure is directed to a refrigerator appliance including a cabinet defining a chilled chamber, a door being operably coupled to the cabinet to provide selective access to the chilled chamber, and a retractable shelf assembly positioned within the chilled chamber.

The shelf assembly can include one or more brackets and a fixed shelf mounted to the one or more brackets. The fixed shelf includes a first guide and a second guide. Each of the first guide and second guide define a first channel and a second channel on opposite transverse sides of the guide. Each of the first guide and second guide also include a support surface. The shelf assembly can also include a movable shelf that is slidably mounted to the fixed shelf. The movable shelf includes a first front boss and a second front boss attached on opposite transverse sides of the movable shelf. The movable shelf can also include a first rear boss and a second rear boss attached on opposite transverse sides of the movable shelf. The first front boss and first rear boss can be received within the first guide and are slidably supported by the support surface of the first guide. Similarly, the second front boss and second rear boss can be received within the second guide and are slidably supported by the support surface of the second guide. In this way, the movable shelf is supported by the first guide and the second guide and is movable between an extended position and a retracted position. The shelf assembly can also include a striker extending from a bottom side of the movable shelf and a soft close mechanism. The soft close mechanism is configured for engaging the striker when the movable shelf is moved in a lateral direction to the closed position.

According to another exemplary embodiment, a shelf assembly for a consumer appliance can include a pair of brackets and a fixed shelf mounted to the pair of brackets. The fixed shelf includes a first guide and a second guide. Each of the first guide and second guide define a first channel and a second channel on opposite transverse sides of the guide. Each of the first guide and second guide also include a support surface. The shelf assembly also includes a movable shelf that is slidably mounted to the fixed shelf. The movable shelf includes a first front boss and a second front boss attached on opposite transverse sides of the movable shelf. The movable shelf also includes a first rear boss and a second rear boss attached on opposite transverse sides of the movable shelf. The first front boss and first rear boss can be received within the first guide and are slidably supported by the support surface of the first guide. Similarly, the second front boss and second rear boss can be received within the second guide and are slidably supported by the support surface of the second guide. In this way, the movable shelf is supported by the first guide and the second guide and is movable between an extended position and a retracted position. The shelf assembly can also include a striker extending from the bottom side of the movable shelf and a soft close mechanism. The soft close mechanism is configured for engaging the striker when the movable shelf is moved in a lateral direction to the closed position.

According to yet another exemplary embodiment, a shelf assembly is provided which defines a vertical direction, a lateral direction, and a transverse direction. The vertical, lateral, and transverse directions are mutually perpendicular. The shelf assembly includes a fixed shelf and a movable shelf. The movable shelf is movable between an extended position and a retracted position. The fixed shelf includes a guide defining a support surface. The support surface can include a front portion and a rear portion along the transverse direction of the guide. The front portion of the support surface is positioned at a first guide angle and the rear portion of the support surface is positioned at a second guide angle.

The movable shelf is slidably mounted to said fixed shelf. The movable shelf also includes a front boss and a rear boss on opposite lateral sides of the movable shelf. The front boss and the rear boss are received within the guide and are slidably supported by the support surface, such that the movable shelf is supported, at least in part, by the guide. The shelf assembly can also include a striker extending from the bottom of the movable shelf. The shelf assembly can also include a soft close mechanism. The soft close assembly can be configured for engaging the striker when the movable shelf is moved in a lateral direction to the closed position and when the rear boss contacts the rear portion of the support surface.

Variations and modifications can be made to these example aspects of the present disclosure. These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
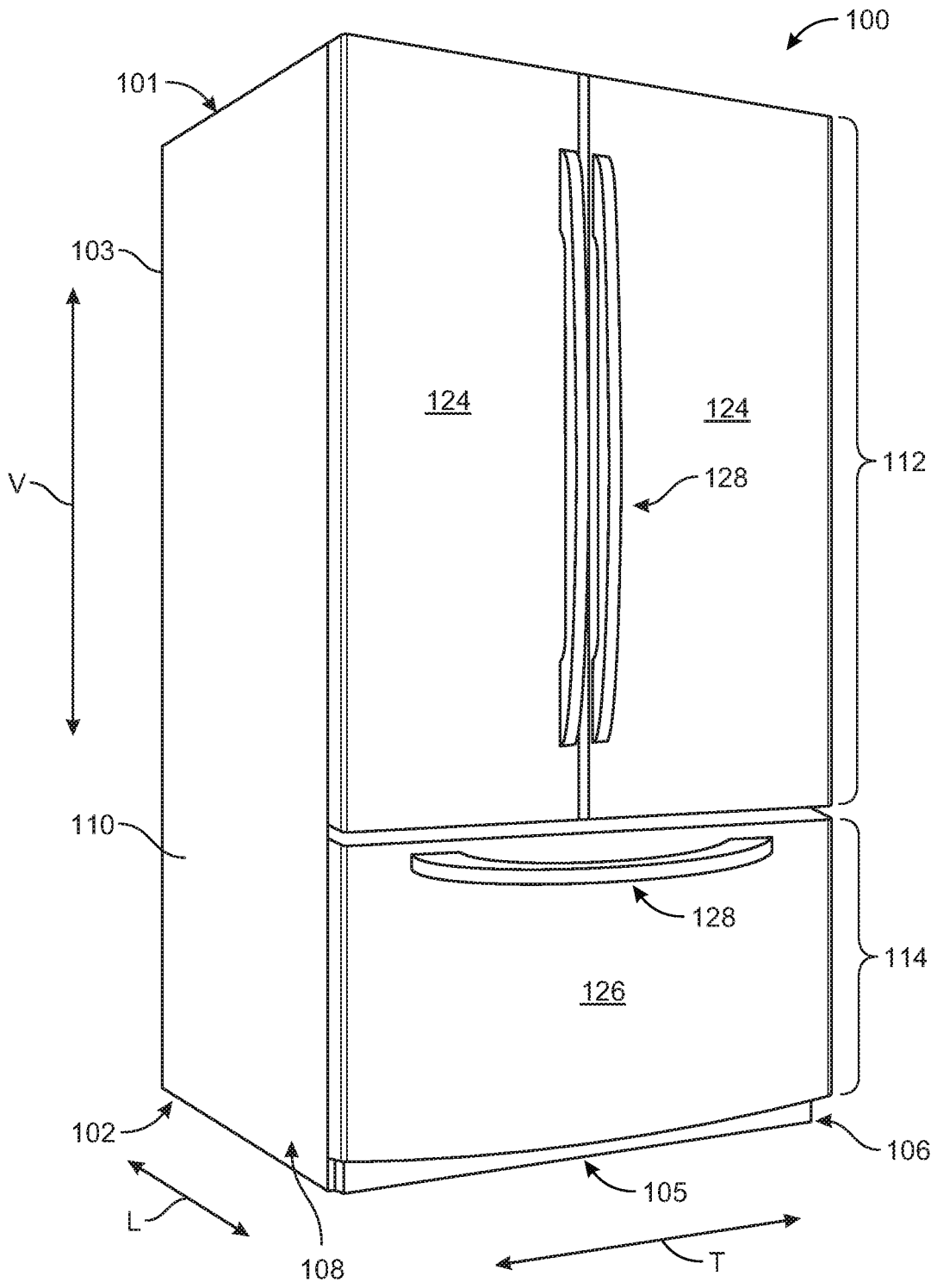
FIG. 1 depicts a front perspective view of a refrigerator appliance according to exemplary embodiments of the present disclosure.

Repeat use of reference characters in the present specification and drawings is intended to represent the same or analogous features or elements of the present disclosure.

DETAILED DESCRIPTION

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

As used herein, terms of approximation, such as "approximately," "substantially," or "about," refer to being within a ten percent margin of error.

Referring now to the figures, example aspects of the present disclosure will be discussed in greater detail.

FIG. 1 provides a perspective view of a refrigerator appliance 100 according to an exemplary embodiment of the present subject matter. Refrigerator appliance 100 defines a vertical direction V, a lateral direction L, and a transverse direction T. The vertical, lateral, and transverse directions V, L, and T are mutually perpendicular and form an orthogonal direction system.

Refrigerator appliance 100 includes a base cabinet or housing 110 that extends between a top portion 112 and a bottom portion 114 along the vertical direction V. Housing 110 defines chilled chambers for receipt of food items for storage. In particular, housing 110 defines fresh food chamber 120 (shown in FIG. 2) positioned at or adjacent top portion 112 of housing 110 and a freezer chamber 122 (shown in FIG. 2) arranged at or adjacent bottom portion 114 of housing 110. As such, refrigerator appliance 100 is generally referred to as a bottom mount refrigerator appliance or a bottom freezer refrigerator appliance. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Housing 110 also extends between a right side portion 106 and a left side portion 108, e.g., along the transverse direction T, forming a front portion 105. Housing 110 defines an opening 140 (shown in FIG. 2) for accessing fresh food chamber 120 (shown in FIG. 2) at or adjacent front portion 105 of housing 110. Housing 110 also includes a back wall 103 extending between a bottom 102 and a top 101, e.g., along the vertical direction V. Housing 110 also includes a left side portion 108 and a right side portion 106, both of which extend between a front portion 105 and a back wall 103, e.g., along the lateral direction L.

Figure 2:
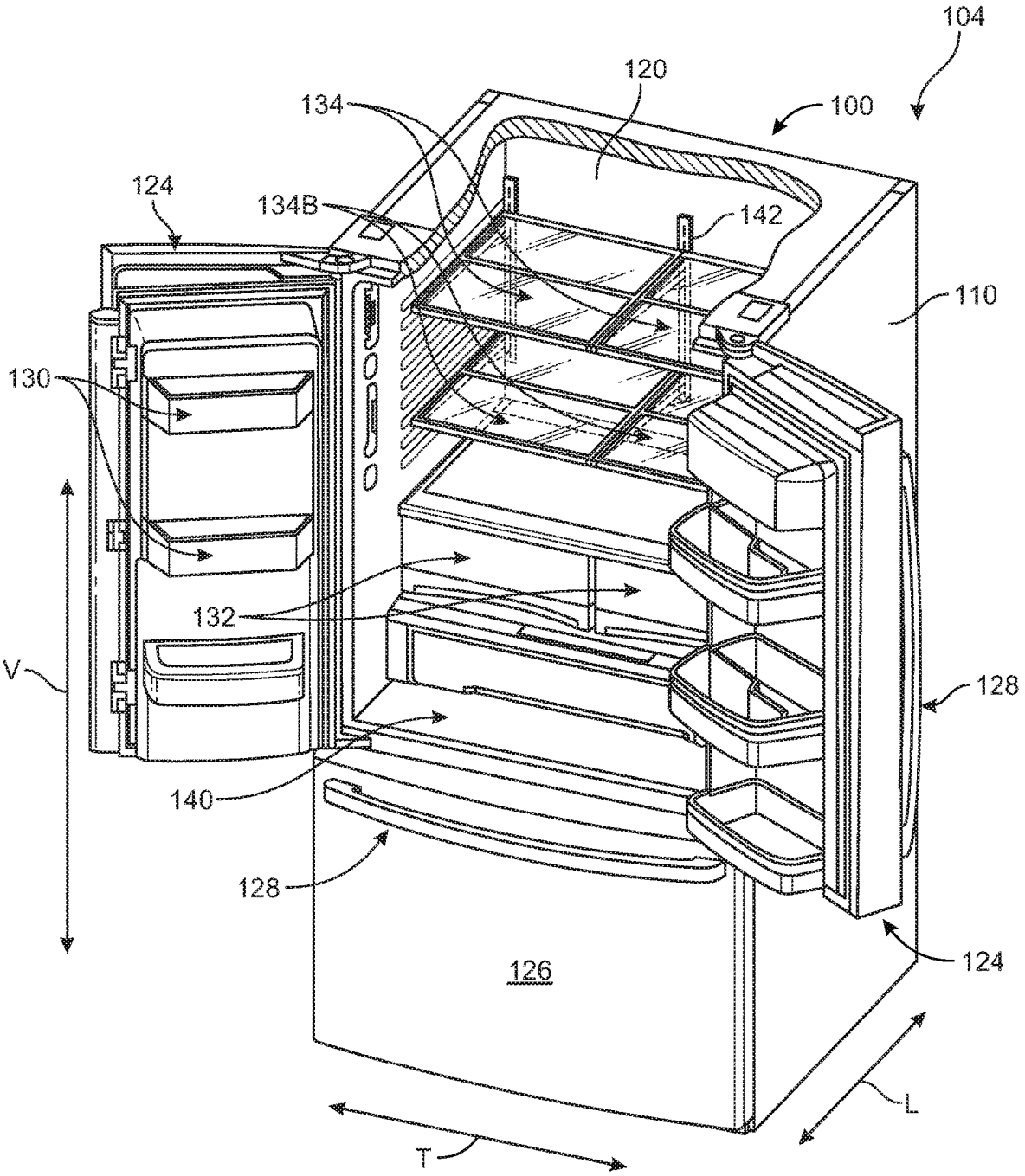
FIG. 2 depicts a perspective view of a refrigerator appliance according to an exemplary embodiment of the present subject matter with doors of the refrigerator appliance shown in an open position and portions of a cabinet of the refrigerator appliance removed to reveal certain components of the exemplary refrigerator appliance of FIG. 1.

FIG. 2 depicts a perspective view of a refrigerator appliance according to an exemplary embodiment of the present subject matter with doors of the refrigerator appliance shown in an open position and portions of a cabinet of the refrigerator appliance removed to reveal certain components of the exemplary refrigerator appliance of FIG. 1.

Refrigerator doors 124 are rotatably mounted or hinged to an edge of housing 110, e.g., at front portion 105 of housing 110, for selectively accessing fresh food chamber or chilled chamber 120. In addition, a freezer door 126 is arranged below refrigerator doors 124 for selectively accessing freezer chamber (not shown). Freezer door 126 is coupled to a freezer drawer (not shown) slidably mounted within freezer chamber (not shown). Refrigerator doors 124 are shown in an closed position and freezer door 126 are shown in a closed position in FIG. 1. Refrigerator doors 124 are shown in an open position and freezer door 126 is shown in a closed position in FIG. 2. In the open position, refrigerator doors 124 permit access to fresh food chamber 120 through opening 140. Conversely, refrigerator doors 124 obstruct or limit access to fresh food chamber 124 through opening 140 in the closed position in FIG. 1. Freezer door 126 operates similarly. Handles 128 can assist with operating refrigerator doors 124 and freezer door 126 between the open and closed positions.

Various storage components are mounted within fresh food chamber 120 to facilitate storage of food items therein as will be understood by those skilled in the art. In particular, the storage components include bins 130, drawers 132, and shelves 134 that are mounted within fresh food chamber 120. Bins 130, drawers 132, and shelves 134 are configured for receipt of food items (e.g., beverages and/or solid food items) and may assist with organizing such food items. As an example, drawers 132 can receive fresh food items (e.g., vegetables, fruits, and/or cheeses) and increase the useful life of such fresh food items.

Although the illustrated embodiment shows two shelves 134 positioned adjacent each other along the transverse direction T and a two additional shelves 134B, that are positioned adjacent to shelves 134 along the vertical direction V, it should be appreciated that aspects of the present disclosure may be applied to other shelf assembly styles and configurations. For example, the shelves 134 or additional shelves 134B could instead include a single storage shelf extending from the right side portion 106 to the left side portion 108 of refrigerator 100 along a transverse direction T. In addition, shelves 134 and additional shelves 134B may have any other suitable sizes or configurations. Moreover, it should be appreciated that shelf assembly 300 as described herein may be utilized as one or more of shelves 134 and additional shelves 134B, and shelf assembly 300 is designed such that shelves 134 may be identical and interchangeable within the refrigerated compartment 120 and can be positioned at mounting points 142 affixed to a wall of cabinet 110, or any other suitable mounting point or location within chilled chamber 120.

Figure 3:
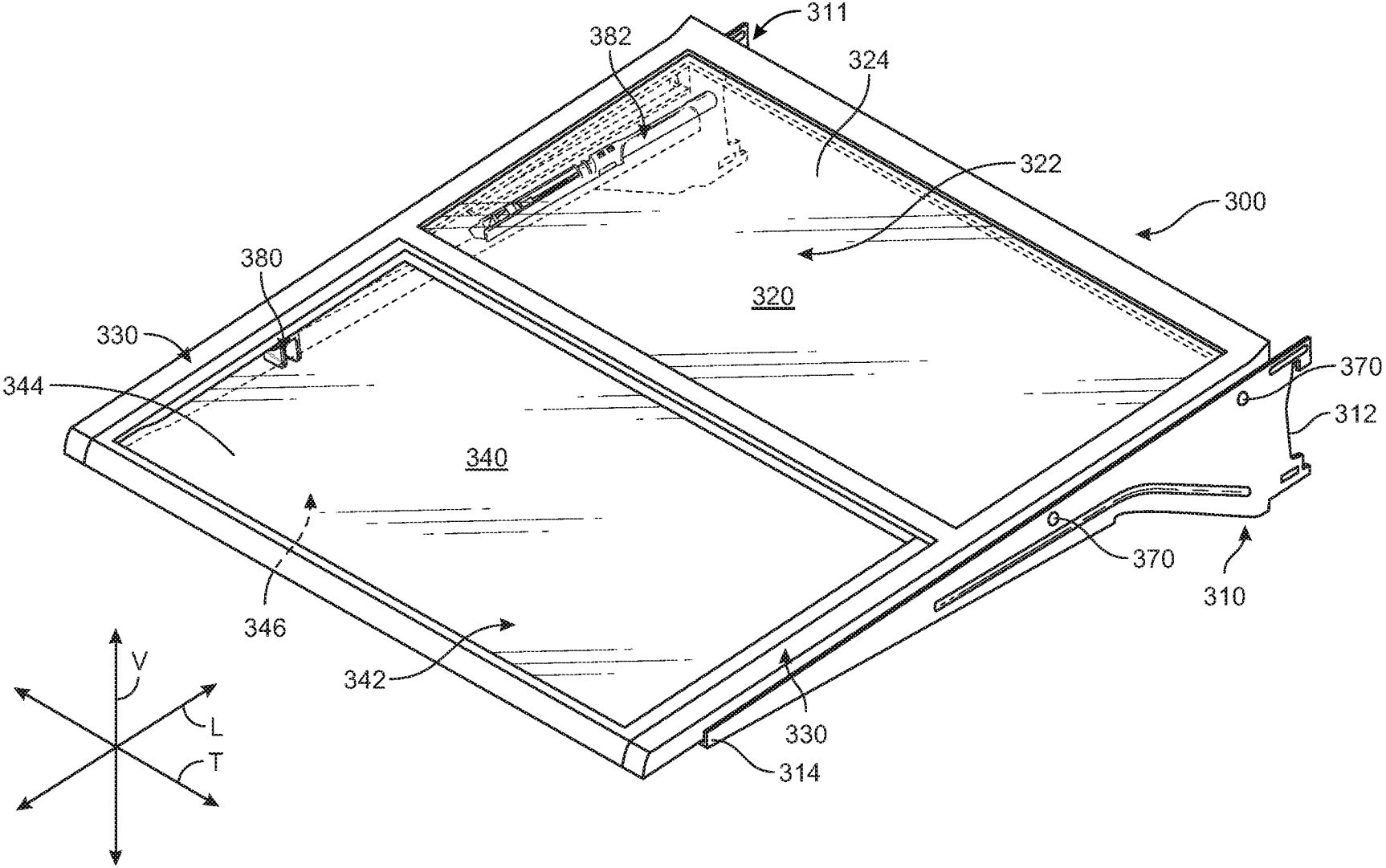
FIG. 3 depicts a perspective view of a shelf assembly according to an exemplary embodiment of the present subject matter with a movable shelf of the shelf assembly shown in a fully extended position.
Figure 4:
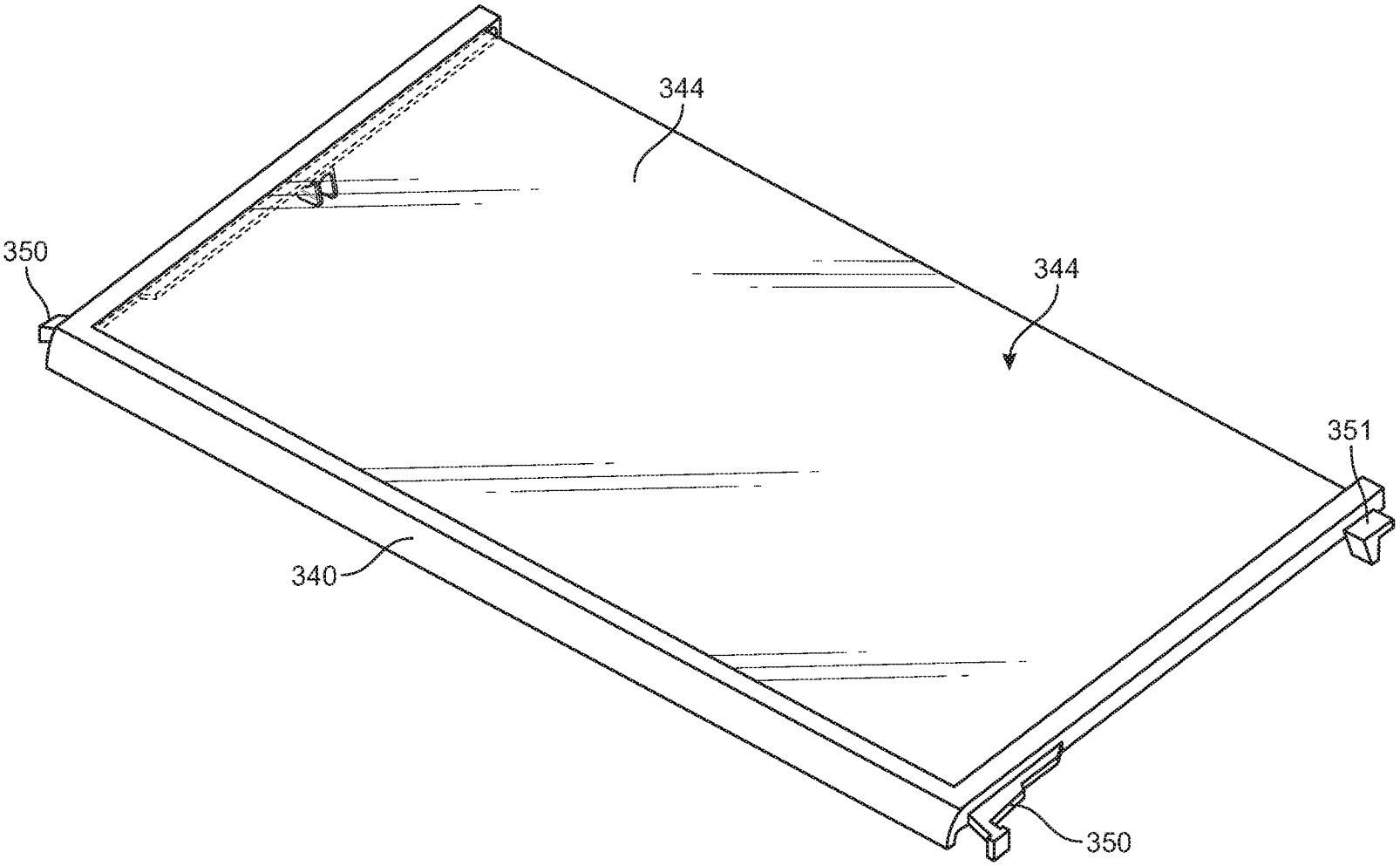
FIG. 4 depicts a perspective view of the movable shelf, of the shelf assembly of FIG. 3, separate from the other components of the shelf assembly for clarity.
Figure 5:
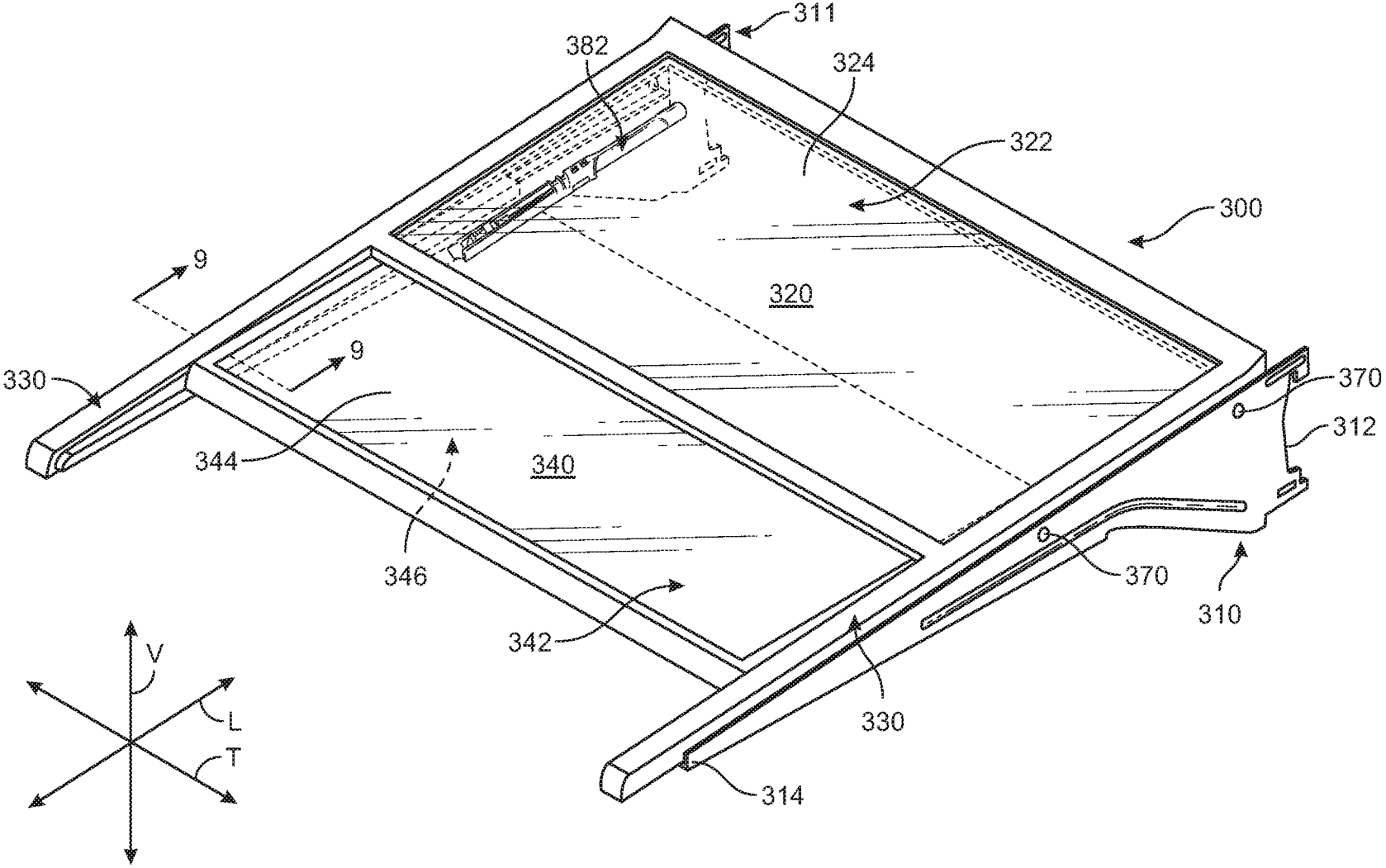
FIG. 5 depicts a perspective view of the shelf assembly of FIG. 3 with the movable shelf of the shelf assembly shown in a partially retracted position.

Referring now generally to FIGS. 3 through 7. FIG. 3 provides a perspective view of a shelf assembly 300 according to an exemplary embodiment of the present subject matter. Shelf assembly 300 is configured for use in any suitable refrigerator appliance. As an example, shelf assembly 300 may be positioned within fresh food chamber 120 of refrigerator appliance 100 and utilized as one or more of shelves (134 and 134B). In FIG. 3, shelf assembly 300 is shown with a movable shelf 340 of shelf assembly 300 in a fully extended position. In FIG. 5, shelf assembly 300 is shown with movable shelf 340 of shelf assembly 300 in a partially retracted position. Conversely, in FIG. 6, shelf assembly 300 is shown with movable shelf 340 of shelf assembly 300 in a fully retracted position. Movable shelf 340 is discussed in greater detail below.

Shelf assembly 300 includes a pair of side supports, such as bracket 310 and bracket 311. Bracket 310 and bracket 311 are spaced apart from each other, e.g., along the transverse direction T. Bracket 310 and bracket 311 can be mounted to cabinet 110, e.g., at mounting points 142 (shown in FIG. 2) of cabinet 110. It should be appreciated that brackets (310 and 311) could be mounted to cabinet 110 in other suitable locations. In particular as shown in FIG. 3, brackets (310 and 311) extend between a proximal end portion 312 and a distal end portion 314, e.g., along the lateral direction L. Proximal end portion 312 of brackets (310 and 311) can be positioned at mounting points 142 (shown in FIG. 2) affixed to a wall of cabinet 110. Conversely, distal end portion 314 of brackets (310 and 311) can positioned within fresh food chamber 120, e.g., adjacent to the front portion 105 of cabinet 110.

A fixed shelf 320 is mounted to brackets (310 and 311), e.g., at proximal end portion 312 of brackets (310 and 311). Thus, fixed shelf 320 extends between and connects brackets (310 and 311), e.g., along the transverse direction T. A plurality of fasteners 370, e.g., screws, bolts, and/or clips, couple fixed shelf 320 to brackets (310 and 311). Fixed shelf 320 includes a glass plate 322 having a top surface 324. Food items can be placed on and/or stored on top surface 324 of glass plate 322, e.g., within fresh food chamber 120. Fixed shelf 320 also has a pair of guides 330 that extend along the lateral direction L, e.g., between about distal and proximal end portions 312 and 314 of each bracket 310 and bracket 311. Each guide of the pair of guides 330 is positioned at a respective one of bracket 310 and bracket 311.

Movable shelf 340 is slidably mounted relative to fixed shelf 320, e.g., at distal end portion 314 of brackets (310 and 311), and can slide relative to fixed shelf 320, e.g., along the lateral direction L. Like fixed shelf 320, movable shelf 340 includes a glass plate 342 having a top surface 344. As discussed above, movable shelf 340 is selectively adjustable between the extended position shown in FIG. 3 and the fully retracted position shown in FIGS. 6 and 7. Food items can be placed on and/or stored on top surface 344 of glass plate 342, e.g., within fresh food chamber 120, when movable shelf 340 is in the extended position. Further, in the extended position, top surface 324 of fixed shelf 320 and top surface 344 of movable shelf 340 can be substantially coplanar, e.g., in a plane that is perpendicular to the vertical direction V. Conversely, in the retracted position, movable shelf 340 is positioned, at least partially, beneath fixed shelf 320, e.g., along the vertical direction V. In the retracted position, food items stored below shelf assembly 300 can extend past shelf assembly 300 along the vertical direction, e.g., due to movable shelf 340 being positioned such that movable shelf 340 does not interfere with or engage such food items.

Figure 7:
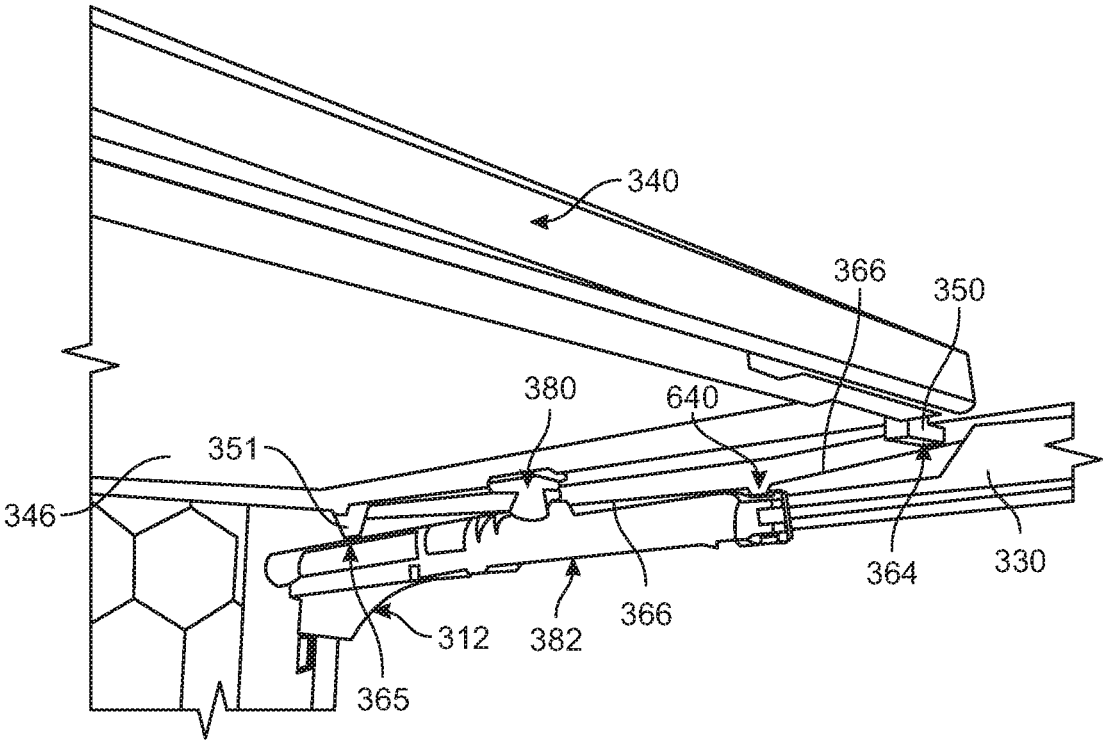
FIG. 7 depicts a partial perspective view of the bottom or underside of a shelf assembly according to an exemplary embodiment of the present subject matter with movable shelf of the shelf assembly shown in a fully retracted position.

Movable shelf 340 has a pair of front bosses 350 and a pair of rear bosses 351 (shown in FIG. 4 and FIG. 7). Front bosses 350 and rear bosses 351 extend away from movable shelf 340, e.g., along the transverse direction T. Front bosses 350 and rear bosses 351 engage guides 330 in order to assist with mounting movable shelf 340 to fixed shelf 320 and facilitating movement of shelf assembly 300, e.g., along the lateral direction L, as discussed in greater detail below.

Figure 6:
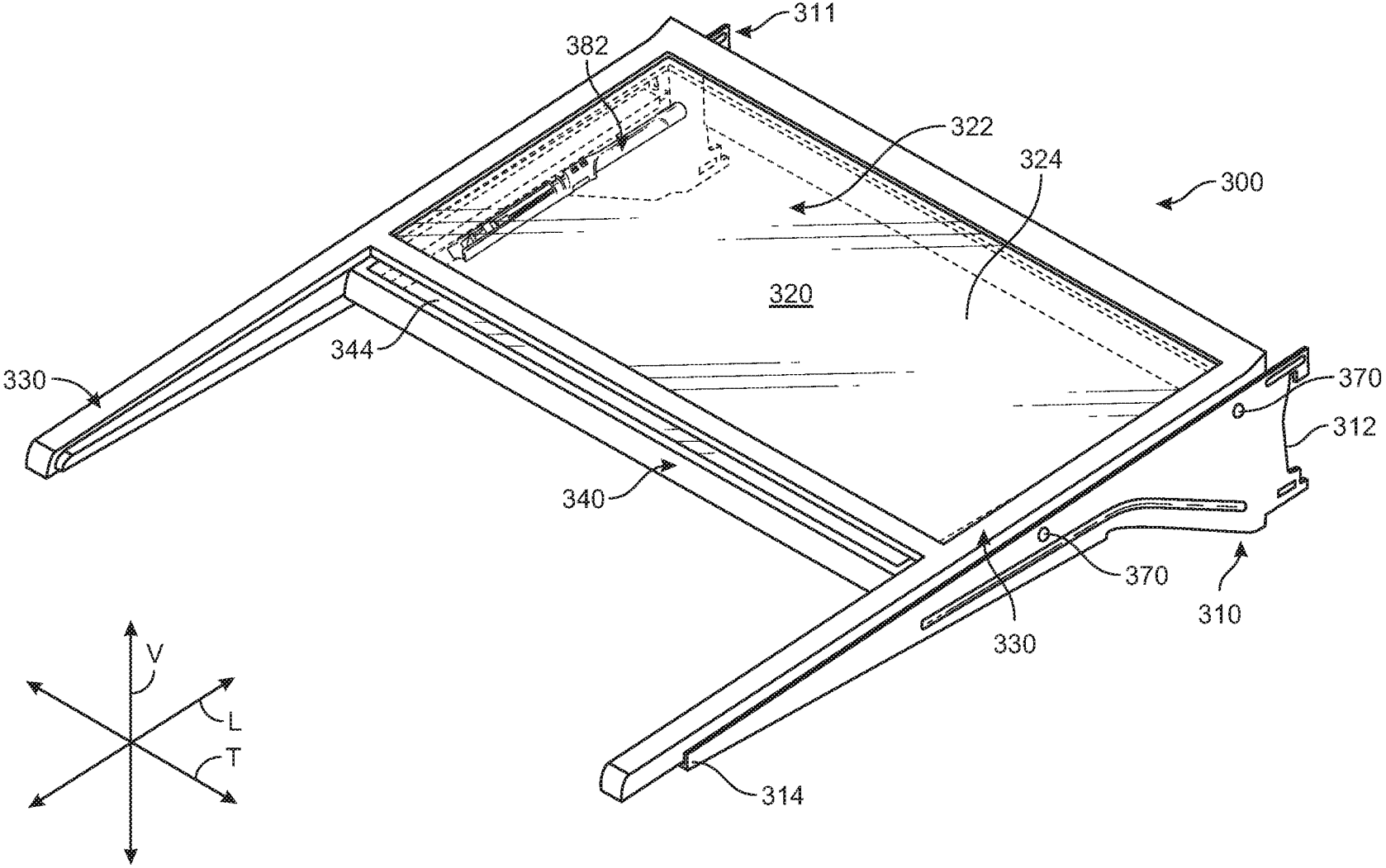
FIG. 6 depicts a perspective view of a shelf assembly according to an exemplary embodiment of the present subject matter with a movable shelf of the shelf assembly shown in a fully retracted position.

Shelf assembly 300 may further include a striker 380 which extends from and below a bottom surface 346 of movable shelf 340, e.g., away from bottom surface 346 along a vertical direction V. In addition, shelf assembly 300 may include a soft close mechanism 382 which is mounted to bracket 311 and is configured for engaging striker 380 when movable shelf 340 is moved toward the retracted position. However, it should be appreciated that according to alternative embodiments, soft close mechanism 382 could be mounted to bracket 310 and striker 380 could be affixed to another location on bottom surface 346 or another area of movable shelf 340 such that it is configured to engage soft close mechanism 382 when movable shelf 340 is operated between an extended position, as shown in FIG. 3, and a fully retracted position, as shown in FIGS. 6 and 7. However, it should be appreciated that according to alternative embodiments, the position of striker 380 and soft close mechanism 382 may mounted to other locations on the movable shelf 340 and fixed shelf 320, respectively, such that the striker 380 is configured to engage the soft close mechanism 382 when movable shelf 340 is operated between an extended position, as shown in FIG. 3, and a fully retracted position, as shown in FIGS. 6 and 7.

As used herein, soft close mechanism 382 is intended to refer to devices, mechanisms, or assemblies which are designed to act as a damper to slow or reduce the velocity of the movable shelf 340 while also engaging the movable shelf and providing assistance or force to move the movable shelf into a fully retracted position, as shown in FIGS. 6 and 7. According to the embodiment illustrated in FIGS. 3-6, soft close mechanism 382 is mounted to bracket 311 and is mounted at an extension angle that is substantially parallel to the guide angle 610 (depicted in FIG. 8), representing the path travel taken by the movable shelf 340, while striker 380 is engaged with soft close mechanism 382, and movable shelf 340 is moving relative to the lateral direction L operated between a partially extended position, as shown in FIG. 5, and a fully retracted position, as shown in FIGS. 6 and 7.

FIG. 4 depicts a perspective view of the movable shelf 340 separated from the shelf assembly 300 of FIG. 3 for clarity. Movable shelf 340 includes a pair of front bosses 350 and a pair of rear bosses 351. One front boss 350 and one rear boss 351 is affixed to each side of movable shelf 340.

Each front boss 350 also includes a bottom surface 364 (shown in FIGS. 7 and 9) that rests on a support surface 366 of guide 330. Each rear boss 351 includes a bottom surface 365 (shown in FIGS. 7 and 8) that rests on a support surface 366 of guide 330. Bottom surface 364 of front boss 350 and bottom surface 365 of rear boss 351 are supported by surface 366 of guide 330 and face each other, e.g., along the vertical direction. In such manner, front boss 350 and rear boss 351 support movable shelf 340 in the vertical direction V and assist with slidably mounting movable shelf 340 to fixed shelf 320. As an example, bottom surface 364 of front boss 350 can slide on support surface 366 of guide 330 during movement of movable shelf 340 along the lateral direction L relative fixed shelf 320. Furthermore, bottom surface 365 of rear boss 351 can slide on support surface 366 of guide 330 during movement of movable shelf 340 along the lateral direction L relative fixed shelf 320.

FIG. 5 provides another perspective view of shelf assembly 300 wherein the movable shelf 340 is shown in partially extended position. In this position soft close mechanism 382 can engage striker 380 (not shown for clarity) to facilitate a soft close operation of movable shelf 340 to the fully retracted position depicted in FIGS. 6 and 7.

Striker 380 engages with the soft close mechanism 382 when the movable shelf 340 is in a partially extended position, such as shown in FIG. 5. In this partially extended position, striker 380 can engage soft close mechanism when bottom surface 365 of rear boss 351 contacts node 640 (shown in FIGS. 7 and 8). In some embodiments, as shown in FIG. 7, node 640 can be a depression or notch in support surface 366. When striker 380 engages soft close mechanism 382, soft close mechanism 382 acts as a damper to slow or reduce the velocity of the movable shelf 340 along the lateral direction L and simultaneously provides assistance or force to movable shelf 340 along the lateral direction L, to allow the movable shelf 340 to move into a fully retracted position, as shown in FIGS. 6 and 7.

FIG. 6 provides another perspective view of shelf assembly 300 wherein the movable shelf 340 is shown in fully retracted position, with striker 380 omitted for clarity. As shown in FIG. 6, substantially all the movable shelf 340 is positioned below fixed shelf 320 when movable shelf 340 is in the fully retracted position.

FIG. 7 depicts a partial perspective view of the underside or bottom of a shelf assembly according to another exemplary embodiment of the present subject matter. Movable shelf 340 of the shelf assembly 300 shown in a fully retracted position. In this exemplary embodiment soft close mechanism 382 is mounted to bracket 312. In the fully retracted position substantially all the movable shelf 340 is positioned below fixed shelf 320 and top surface 344 is substantially parallel to top surface 324 along lateral direction L. While striker 380 is engaged with soft close mechanism 382, movable shelf 340 can be moved relative to the lateral direction L by soft close mechanism 382.

Figure 8:
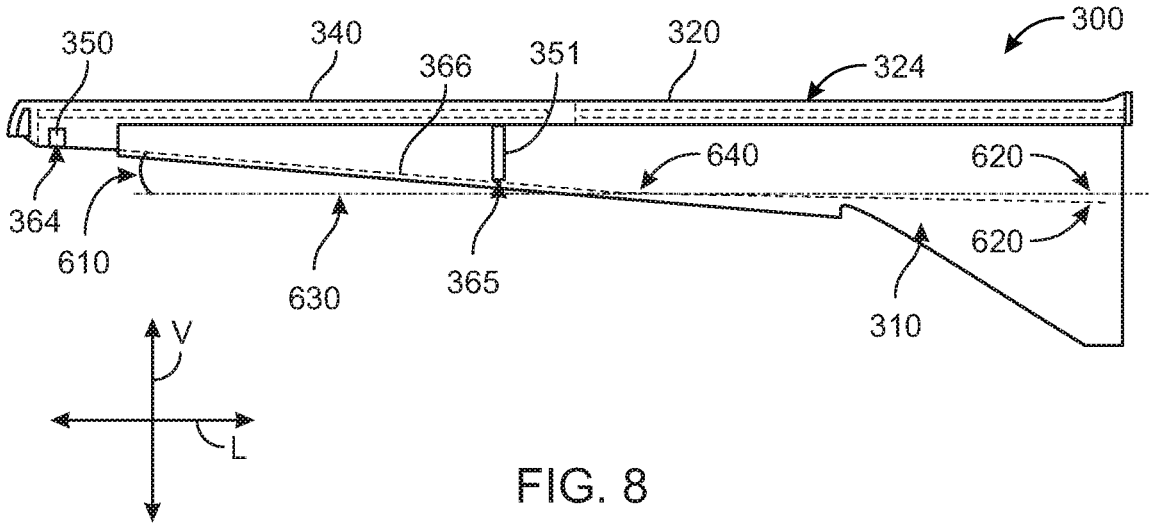
FIG. 8 depicts a side view of the shelf assembly of FIG. 3, without the inclusion of the soft close mechanism or brackets, in order to provide an unobstructed view of one of the guides of the fixed shelf of the shelf assembly of FIG. 3.

Striker 380 engages with the soft close mechanism 382 when the movable shelf 340 is in a partially extended position (as depicted in FIG. 5). In this partially extended position, when striker 380 engages soft close mechanism, bottom surface 365 of rear boss 351 contacts node 640. As shown in FIG. 7, node 640 can be a depression or notch in support surface 366. Alternatively, node 640 can be an arc or angled intersection in support surface 366 formed by the intersection of the portion of support surface 366, which is positioned consistent with the first guide angle 610 and second guide angle 620 (as depicted in FIG. 8). When striker 380 engages soft close mechanism 382, soft close mechanism 382 acts as a damper to slow the velocity of the movable shelf 340 and simultaneously provides assistance or force to movable shelf 340 along lateral direction L, to allow the movable shelf 340 to move into a fully retracted position, as shown in FIGS. 6 and 7. As shown in FIG. 7, in the fully retracted position, bottom surface 365 of rear boss 351 is in contact with the portion of support surface 366, which is positioned consistent with the second guide angle 620 (shown in FIG. 8) and the bottom surface 364 or front boss 350 is in contact with the portion of support surface 366, which is positioned consistent with the first guide angle 610 (shown in FIG. 8).

FIG. 8 provides a side view of shelf assembly 300, with bracket 310 omitted for clarity. In certain embodiments of the present disclosure, bottom surface 364 of front boss 350 can slide on support surface 366 of guide 330 during movement of movable shelf 340 along the lateral direction L relative fixed shelf 320. Bottom surface 365 of rear boss 351 can also slide on support surface 366 of guide 330 during movement of movable shelf 340 along the lateral direction L relative fixed shelf 320.

Support surface 366 can have a first guide angle 610 and a second guide angle 620. The first guide angle 610 and second guide angle 620 are the angle of the support surface 366 relative to the position of the top surface 324 of fixed shelf 320, represented by reference line 630. Reference line 630 depicted in FIG. 8 is substantially parallel to the top surface 324 of fixed shelf 320. Further, second guide angle 620 is substantially parallel to reference line 630, e.g., in a parallel plane that is along a lateral direction L which is the path of movement of movable shelf 340 relative to fixed shelf 320 when movable shelf is moving from an extended position to a fully retracted position.

Support surface 366 transitions between first guide angle 610 and second guide angle 620 at node 640. When operation of the movable shelf 340 is initiated by a user from a fully extended position, as depicted in FIG. 3, to a fully retracted position, as depicted in FIGS. 6 and 7, bottom surface 364 of front boss 350 slides upon support surface 366 of guide 330 along the first guide angle, e.g., along the lateral direction L. Similarly, bottom surface 365 of rear boss 351 slides upon support surface 366 of guide 330 along the first guide angle, e.g., along the lateral direction L, until bottom surface 365 contacts node 640. Movement of movable shelf 340 along the first guide angle can be accomplished by gravity and/or user input, i.e., by the user pushing the movable shelf, until striker 380 engages soft close mechanism 382. When rear boss 351 reaches or contacts node 640, striker 380 engages soft close mechanism 382 to facilitate a soft close operation of movable shelf 340, until movable shelf 340 is in a fully retracted position, such as depicted in FIGS. 6 and 7.

Figure 9:
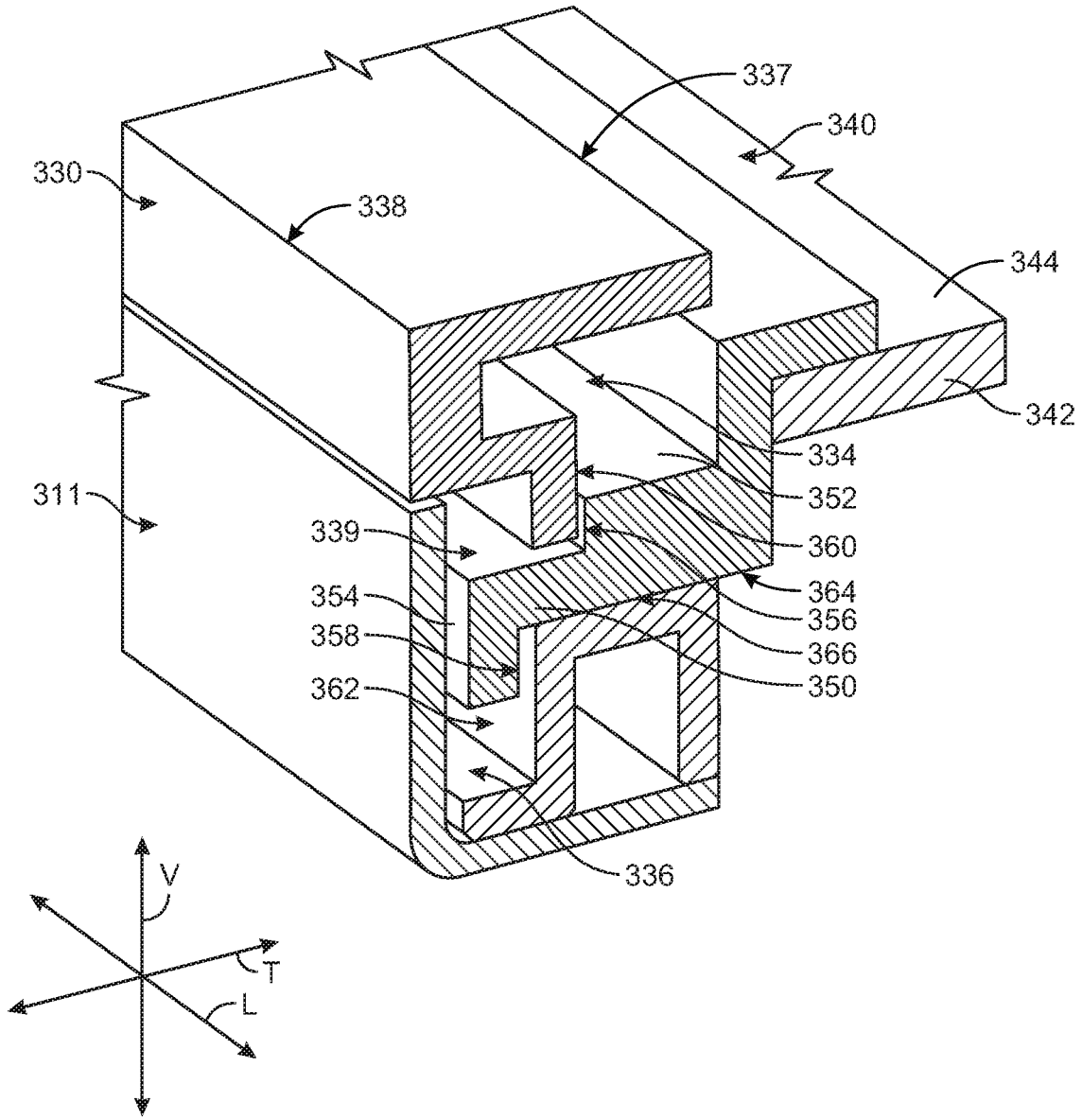
FIG. 9 depicts a partial section view of the shelf assembly taken along the 9-9 section line of FIG. 5.

FIG. 9 provides a partial section view of shelf assembly 300 taken along the 9-9 section line of FIG. 5. As may be seen in FIG. 9, guide 330 defines a first channel 334 and a second channel 336. First and second channels 334 and 336 are positioned on opposite transverse sides of guide 330. In particular, first channel 334 is positioned at or adjacent a first transverse side 337 of guide 330, and second channel 334 is positioned at or adjacent a second transverse side 338 of guide 330. First and second transverse sides 337 and 338 positioned opposite each other on guide 330 and spaced apart from each other along the transverse direction T.

Guide 330 also defines a slot 339 that extends between and connects first and second channels 334 and 336, e.g., along the transverse direction T. Front boss 350 of movable shelf 340 is, e.g., slidably, received within slot 339 of guide 330. Front boss 350 has a first locking portion 352 and a second locking portion 354. First locking portion 352 of front boss 350 is positioned within first channel 334 of guide 330 and engages fixed shelf 320 at first channel 334. In particular, a contact surface 356 of first locking portion 352 is positioned adjacent or against a first surface 360 of guide 330. Second locking portion 354 of first boss 350 is positioned within second channel 336 of guide 330 and engages fixed shelf 320 at second channel 336. In particular, a contact surface 358 of second locking portion 354 is positioned adjacent or against a second surface 362 of guide 330. First and second surfaces 360 and 362 are positioned on opposite transverse sides of guide 330, e.g., such that first and second surfaces 360 and 362 are spaced apart from each other along the transverse direction T. In particular, first surface 360 of guide 330 is positioned on or proximate first transverse side 337 of guide 330. Conversely, second surface 362 of guide 330 is positioned on or proximate second transverse side 338 of guide 330.

First and second locking portions 354 and 356 of front boss 350 each include contact surfaces 358 and 360, respectively. Contact surface 358 of first locking portion 352 and contact surface 358 of second locking portion 354 face opposite ways, e.g., along the transverse direction T. Thus, contact surface 358 of first locking portion 352 and contact surface 358 of second locking portion 354 may face each other along the transverse direction T or may face away from each other along the transverse direction T.

Front boss 350 also includes a bottom surface 364 that rests on a support surface 366 of guide 330. Bottom surface 364 of front boss 350 and support surface 366 of guide 330 face each other, e.g., along the vertical direction V. In such manner, front boss 350 supports movable shelf 340 in the vertical direction V and assists with slidably mounting movable shelf 340 to fixed shelf 320. As an example, bottom surface 364 of front boss 350 can slide on support surface 366 of guide 330 during movement of movable shelf 340 along the lateral direction L relative fixed shelf 320.

As may be seen in FIG. 9, first and second locking portions 352 and 354 of front boss 350 can be spaced apart from each other, e.g., along at least one of the vertical direction V and the transverse direction T. First and second locking portions 352 and 354 are configured for hindering racking and/or movement of shelf assembly 300, e.g., in the transverse direction T. As an example, when first and second locking portions 352 and 354 engage guide 330 at both first and second channels 334 and 336 of guide 330, shelf assembly 300, bracket 310, bracket 311, and movable shelf 340 can be hindered from moving or permitted limited movement, e.g., in the transverse direction T, without cross-bars extending between bracket 310 and bracket 311. Thus, by providing shelf assembly 300 with boss 350, bracket 310 and bracket 311 can attached or mounted to fixed shelf 320 with fasteners 370 and not require any additional mechanical coupling therebetween, such as cross bars that extend between bracket 310 and bracket 311, e.g., along the transvers direction T. Furthermore, by providing shelf assembly 300 with the first and second locking portions 352 and 354 such that they engage guide 330 at both first and second channels 334 and 336 of guide 330, shelf assembly 300, bracket 310, bracket 311, and movable shelf 340 can be hindered from moving or permitted limited movement, e.g., in the transverse direction T, which allows for the use of a single soft close mechanism 382 mounted to either bracket 310 and bracket 311 to facilitate the movement of the movable shelf 340 without causing movable shelf 340 to rack and/or move which could bind or otherwise hinder the movement of the moveable shelf 340 to a fully retracted position, such as depicted in FIGS. 6 and 7.

First surface 360 of guide 330 and second surface 362 of guide 330 face opposite ways, e.g., along the transverse direction T. Thus, first surface 360 of guide 330 and second surface 362 of guide 330 may face each other along the transverse direction T or may face away from each other along the transverse direction T. First surface 360 of guide 330 faces first transverse side 337 of guide 330. Conversely, second surface 362 of guide 330 faces second transverse side 338 of guide 330.

Figure 10:
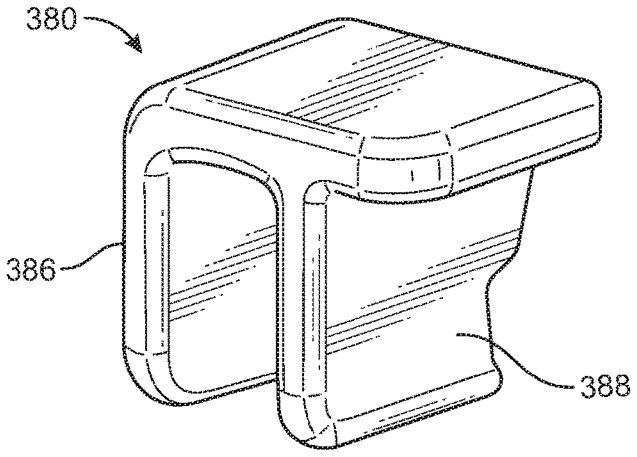
FIG. 10 depicts a perspective view of a striker on the exemplary shelf assembly of FIGS. 3, 5 and 7.
Figure 11:
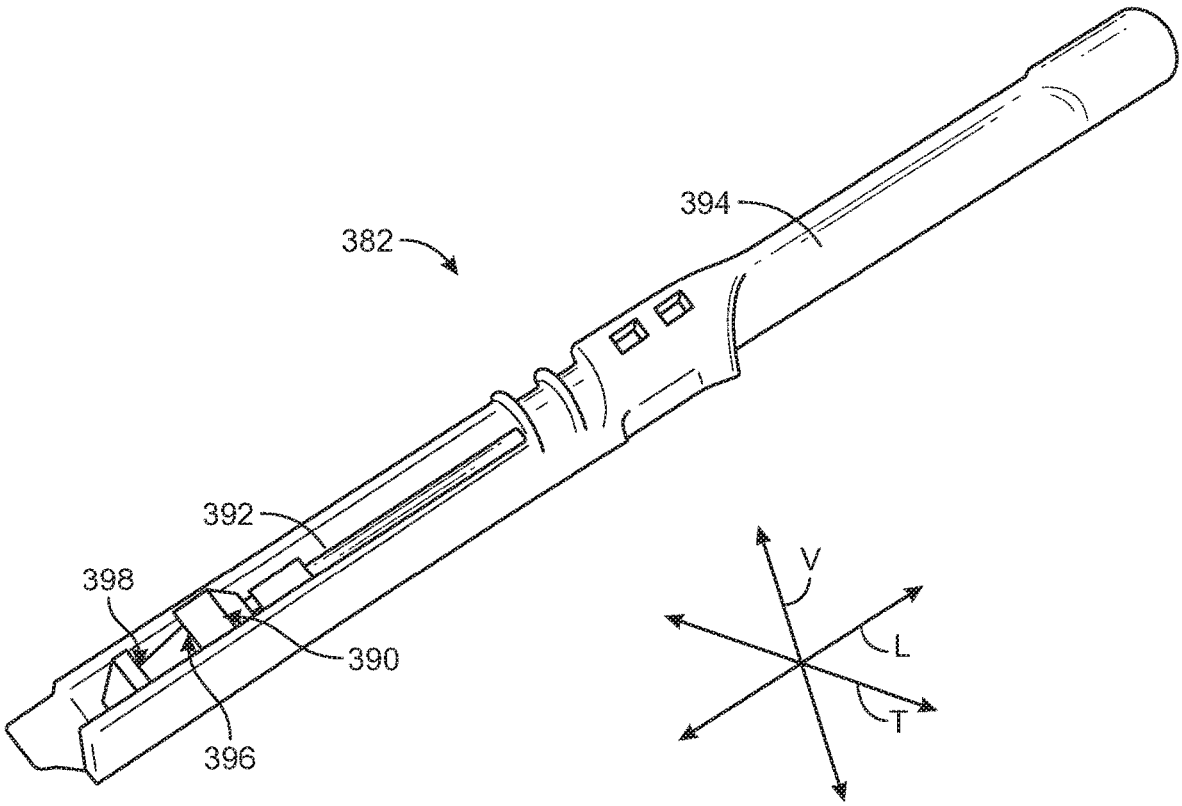
FIG. 11 depicts a soft close mechanism in an extended position for use with the exemplary shelf assembly of FIGS. 3 and 5-7.

Referring now specifically to FIGS. 10 and 11, the manner in which a soft close mechanism 382 engages striker 380 to facilitate a soft close operation of movable shelf 340 will be described according to an exemplary embodiment of the present subject matter. In this regard, FIG. 10 provides a perspective view of a striker 380, which generally defines a rear face or striking face 386 and a front face or locking face 388. In addition, FIG. 11 provides a perspective view of a soft close mechanism 382, which defines a pivoting head 390 mounted on the distal end of a piston rod 392. Piston rod 392 is slidable along the lateral direction L within a cylinder assembly 394 which provides the damping and retraction forces to piston rod 392.

Thus, during operation, as movable shelf 340 is moved toward the fully retracted position, striking face 388 of striker 380 impacts a first face 396 of pivoting head 390. As movable shelf 340 continues to move toward the fully retracted position, pivoting head 390 pivots relative to piston rod 392 such that a second face 398 of pivoting head 390 engages locking face/rear striking face 386 of striker 380. At this point, striking face 388 and locking face 386 of striker 380 are sandwiched between first face 396 and second face 398 of pivoting head 390 such that movable shelf 340 moves with pivoting head 390 along the lateral direction L. Through this linkage, cylinder assembly 394 may act to damp the closing motion of movable shelf 340 via piston rod 392. Simultaneously, cylinder assembly 394 may draw movable shelf 340 into the fully retracted position.

When a user desires to return the movable shelf 340 to the fully extended position, they may pull on the movable shelf such that locking face 386 of striker 380 pulls against second face 398 of pivoting head 390 and extends piston rod 392 within cylinder assembly 394. After piston rod 392 has reached its full extension, the force of locking face 386 against second face 398 forces pivoting head 390 to pivot away from and release striker 380 altogether. Piston rod 392 may be configured for remaining in the extended position until a subsequent retracting process of movable shelf 340. It should be appreciated that the soft close mechanism described is only exemplary and that other soft close mechanisms may be used according to alternative embodiments.

Although specific features of various embodiments may be shown in some drawings and not in others, this is for convenience only. In accordance with the principles of the present disclosure, any feature of a drawing can be referenced and/or claimed in combination with any feature of any other drawing.

This written description uses examples for the disclosure, including the best mode, and also to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, the refrigerator appliance defining a vertical direction, a lateral direction, and a transverse direction, the vertical, lateral, and transverse directions being mutually perpendicular, the refrigerator appliance comprising:

a cabinet defining a chilled chamber;

a door being operably coupled to the cabinet to provide selective access to the chilled chamber; and a shelf assembly positioned within the chilled chamber, the shelf assembly comprising:

a fixed shelf having a first guide and a second guide, each of the first guide and second guide defining a first channel and a second channel on opposite sides of the guide along the lateral direction, each of the first guide and second guide including a support surface;

a front portion of the support surface of the first guide and a rear portion of the support surface of the first guide, the rear portion extending along a transverse direction of the first guide, wherein the front portion of the first support surface is positioned at a first guide angle and the rear portion of the first support surface is positioned at a second guide angle, and wherein the front portion of the first support surface and the rear portion of the first support surface intersect at a node comprising a depression in the first support surface;

a front portion of the support surface of the second guide and a rear portion of the support surface of the second guide, wherein the front portion of the second support surface is positioned at the first guide angle and the rear portion of the second support surface is positioned at a second guide angle;

a movable shelf slidably mounted to said fixed shelf, said movable shelf having a first front boss and a second front boss attached on opposite transverse sides of the movable shelf and a first rear boss and a second rear boss attached on opposite transverse sides of the movable shelf, wherein the first front boss and first rear boss are received within the first guide and are slidably supported by the support surface of the first guide, and the second front boss and second rear boss are received within the second guide and are slidably supported by the support surface of the second guide, such that the movable shelf is supported by the first guide and the second guide and is movable between an extended position and a retracted position;

a striker extending from a bottom side of the movable shelf; and a soft close mechanism being configured for engaging the striker when the movable shelf is moved in a lateral direction to the closed position.

2. The refrigerator appliance of claim 1, wherein the fixed shelf further comprises a top surface and the second guide angle is substantially parallel to the top surface of the fixed shelf.

3. The refrigerator appliance of claim 1, wherein the striker is configured to engage the soft close mechanism when the first rear boss of movable shelf contacts the node when movable shelf is moved toward the retracted position.

4. The refrigerator appliance of claim 3, wherein the soft close mechanism is configured to reduce a moving velocity of the movable shelf and simultaneously provide force to the striker in the lateral direction to facilitate movement of the movable shelf to the retracted position.

5. The refrigerator appliance of claim 4, wherein the first channel and a second channel of each of the first guide and second guide are configured for hindering racking of the shelf assembly in the transverse direction.

6. The refrigerator appliance of claim 5, further comprising a pair of brackets, wherein the soft close mechanism is mounted to one of the pair of brackets.

7. The refrigerator appliance of claim 6, wherein the soft close mechanism is mounted at an extension angle relative to the transverse direction, and wherein the extension angle is substantially equivalent to the second guide angle.

8. A shelf assembly for a consumer appliance, the shelf assembly defining a vertical direction, a lateral direction, and a transverse direction, the vertical, lateral, and transverse directions being mutually perpendicular, the shelf assembly comprising:

a pair of brackets;

a fixed shelf mounted to said pair of brackets, said fixed shelf having a first guide and a second guide, each of the first guide and second guide defining a first channel and a second channel on opposite transverse sides of the guide, each of the first guide and second guide including a support surface;

a front portion of the support surface of the first guide and a rear portion of the support surface of the first guide, the rear portion extending along a transverse direction of the first guide, wherein the front portion of the first support surface is positioned at a first guide angle and the rear portion of the first support surface is positioned at a second guide angle, and wherein the front portion of the first support surface and the rear portion of the first support surface intersect at a node comprising a depression in the first support surface;

a front portion of the support surface of the second guide and a rear portion of the support surface of the second guide, wherein the front portion of the second support surface is positioned at the first guide angle and the rear portion of the second support surface is positioned at a second guide angle;

a movable shelf slidably mounted to said fixed shelf, said movable shelf having a first front boss and a second front boss attached on opposite transverse sides of the movable shelf and a first rear boss and a second rear boss attached on opposite transverse sides of the movable shelf, wherein the first front bosses and first rear boss are received within the first guide and are slidably supported by the support surface of the first guide, and the second front boss and second rear boss are received within the second guide and are slidably supported by the support surface of the second guide, such that the movable shelf is supported by the first guide and the second guide and being movable between an extended position and a retracted position;

a striker extending from a bottom side of the movable shelf; and a soft close mechanism mounted to one of the pair of brackets and being configured for engaging the striker when the movable shelf is moved in a lateral direction to the closed position.

9. The shelf assembly of claim 8, wherein the fixed shelf further comprises a top surface and the second guide angle is substantially parallel to the top surface of the fixed shelf.

10. The shelf assembly of claim 8, wherein the front portion of the first support surface and the rear portion of the first support surface intersect at a node.

11. The shelf assembly of claim 10, wherein the striker is configured to engage the soft close mechanism when the first rear boss of movable shelf contacts the node of first support surface when movable shelf is moved in the later direction toward the retracted position.

12. The shelf assembly of claim 11, wherein the soft close mechanism is configured to reduce a moving velocity of the movable shelf and simultaneously provide force to the striker in the lateral direction to facilitate movement of the movable shelf to the retracted position.

13. The shelf assembly of claim 12, wherein the first channel and a second channel of each of the first guide and second guide are configured for hindering racking of said shelf assembly in the transverse direction.

14. The shelf assembly of claim 13, wherein the soft close mechanism is mounted at an extension angle relative to a transverse direction, and wherein the extension angle is substantially equivalent to the second guide angle.

15. A shelf assembly, the shelf assembly defining a vertical direction, a lateral direction, and a transverse direction, the vertical, lateral, and transverse directions being mutually perpendicular, the shelf assembly comprising:

a fixed shelf, said fixed shelf having a first guide and a second guide, each of the first guide and second guide defining a support surface including a front portion and a rear portion along the transverse direction of the guide, wherein the front portion of each of the support surfaces are positioned at a first guide angle and the rear portion of each of the support surfaces are positioned at a second guide angle, and wherein the front portion of each of the support surfaces and the rear portion of the first support surface intersect at a node comprising a depression in the first support surface;

a movable shelf slidably mounted to said fixed shelf, said movable shelf having a front boss and a rear boss on opposite lateral sides of the movable shelf, wherein the front boss and rear boss are received within the guide and are slidably supported by the support surface, such that the movable shelf is supported, at least in part, by the guide and the movable shelf being movable between an extended position and a retracted position;

a striker extending from a bottom side of the movable shelf; and a soft close mechanism being configured for engaging the striker when the movable shelf is moved in a lateral direction to the closed position and when the rear boss contacts the rear portion of the support surface.

* * * * *